US010844711B2

(12) United States Patent
Cooper et al.

(10) Patent No.: US 10,844,711 B2
(45) Date of Patent: Nov. 24, 2020

(54) SYSTEM AND METHOD FOR TRIAXIAL TESTING OF CORE SAMPLES AT HIGH TEMPERATURES

(71) Applicant: Big Guns Energy Services Inc., Calgary (CA)

(72) Inventors: Peter Cooper, Calgary (CA); Ming Liu, Calgary (CA); Dickson Lee, Calgary (CA)

(73) Assignee: BIG GUNS ENERGY SERVICES INC., Calgary (CA)

( * ) Notice: Subject to any disclaimer, the term of this patent is extended or adjusted under 35 U.S.C. 154(b) by 319 days.

(21) Appl. No.: 15/991,559

(22) Filed: May 29, 2018

(65) Prior Publication Data

US 2018/0340417 A1 Nov. 29, 2018

Related U.S. Application Data

(60) Provisional application No. 62/511,438, filed on May 26, 2017.

(51) Int. Cl.

| | |
|---|---|
| ***E21B 49/06*** | (2006.01) |
| ***E21B 49/10*** | (2006.01) |
| ***E21B 33/12*** | (2006.01) |
| ***E21B 49/02*** | (2006.01) |

(52) U.S. Cl.

CPC ..... *E21B 49/06* (2013.01); *E21B 33/1208* (2013.01); *E21B 49/02* (2013.01); *E21B 49/10* (2013.01); *E21B 2200/01* (2020.05)

(58) Field of Classification Search

CPC ..... E21B 49/02; E21B 49/06; E21B 49/10; E21B 2201/01; E21B 33/1208

See application file for complete search history.

(56) References Cited

U.S. PATENT DOCUMENTS 3,199,341 A * 8/1965 Heuer, Jr. ..... G01N 11/00 73/807

4,579,003 A 4/1986 Riley (Continued)

FOREIGN PATENT DOCUMENTS

CN 202133591 2/2012
CN 102507307 6/2012

(Continued)

*Primary Examiner* — John Fitzgerald

(74) *Attorney, Agent, or Firm* — Snell & Wilmer L.L.P.; Russell T. Manning

(57) ABSTRACT

A triaxial test system and method including a core sample, high temperature-resistant drains disposed around the core sample, and at least one and optionally two high temperature-resistant elastomeric sealing membranes disposed about the drains and sample. Preferred for use is a shear-resistant and high temperature-resistant sealing membrane such as a Viton membrane, optionally in combination with a silicone high temperature-resistant sealing membrane. The system and methods can be used to test core samples in compliance with ASTM standard test methods for triaxial compression tests, at temperatures of between about 100° C. and 200° C., optionally between about 175° C. and 200° C., for extended periods of time, for example several days or longer.

22 Claims, 4 Drawing Sheets

(56) References Cited

U.S. PATENT DOCUMENTS

| | | | | | |
|---|---|---|---|---|---|
| 4,587,857 | A * | 5/1986 | Bush | G01N 33/24 | 73/863 |
| 4,649,737 | A * | 3/1987 | Jones | G01N 15/08 | 73/38 |
| 4,710,948 | A * | 12/1987 | Withjack | G01N 23/04 | 378/208 |
| 5,025,668 | A | 6/1991 | Sarda | | |
| 5,159,828 | A * | 11/1992 | Steiger | E21B 49/006 | 73/38 |
| 5,226,310 | A * | 7/1993 | Steiger | E21B 49/006 | 73/38 |
| 5,253,518 | A * | 10/1993 | Steiger | E21B 49/006 | 166/250.01 |
| 5,359,903 | A * | 11/1994 | Steiger | G01N 29/07 | 73/862.627 |
| 5,493,226 | A | 2/1996 | Honarpour | | |
| 6,247,358 | B1 | 6/2001 | Dos Santos | | |
| 6,591,690 | B1 | 7/2003 | Crockford | | |
| 7,143,653 | B2 | 12/2006 | Abdel-Hadi | | |
| 8,561,474 | B2 | 10/2013 | Secq | | |
| 9,880,081 | B1 * | 1/2018 | Gupta | G01N 3/08 | |
| 9,983,277 | B2 * | 5/2018 | Peterson | E21B 25/00 | |
| 10,209,324 | B2 * | 2/2019 | Fordham | G01R 33/305 | |
| 2015/0267370 | A1 | 9/2015 | Gupta | | |
| 2015/0268314 | A1 * | 9/2015 | Peterson | G01R 33/305 | 324/321 |
| 2018/0335374 | A1 * | 11/2018 | Kanj | E21B 49/006 | |
| 2019/0331566 | A1 * | 10/2019 | Liu | F16C 35/06 | |

FOREIGN PATENT DOCUMENTS

| | | | |
|---|---|---|---|
| CN | 102901676 | | 1/2013 |
| CN | 102980990 | | 3/2013 |
| CN | 03698228 | | 4/2014 |
| CN | 104316447 | A * | 1/2015 |
| CN | 104374624 | | 2/2015 |
| CN | 209784080 | U * | 12/2019 |
| FR | 2641868 | | 7/1990 |

* cited by examiner

SYSTEM AND METHOD FOR TRIAXIAL TESTING OF CORE SAMPLES AT HIGH TEMPERATURES

CROSS-REFERENCE TO RELATED APPLICATIONS

This application claims the benefit of U.S. Provisional App. No. 62/511,438, filed May 26, 2017, the entire contents of which are incorporated herein as if set forth in full.

TECHNICAL FIELD

Apparatus and methodologies are provided for testing of geological materials (deformable solids), such as soils and rocks. More specifically, improved apparatus and methodologies for sampling and performing triaxial testing of core samples at high temperatures are provided.

BACKGROUND

Many methods of testing the physical properties of soils and rocks are known. One of the most common methods of comprehensively determining mechanical properties is triaxial testing. Triaxial testing is accomplished with cylindrical samples that are subjected to a uniform external fluid pressure and mechanical axial compression. There are a number of variations that exist, some of which are described by various standards. There is a need for improved apparatus and methodologies for determining geomechanical properties of core samples, particularly those that operate at high temperatures over an extended period of time.

Geological materials, such as soils and rocks, are both porous and permeable and are generally tested with the sample fully saturated with a fluid. When these materials are deformed, the fluid pressure inside the sample increases and can be quantified by measuring the increase in pressure (as estimated using an external pressure transducer) and accounting for this in material calculations, or by providing an exit mechanism that allows the fluid to drain from the sample, and that allows sufficient time for the pressurized fluid to drain. The first method is typically referred to as an "undrained" test, while the second method is a "drained" test. In both styles of testing, it is desirable that the fluid pressure be uniform within the sample and the transducer location. The drainage paths and material properties from all points within the samples are never exactly the same.

With low permeability samples, such as clays and shales, fluid pressure equalization is much slower. As such, external drains are often provided around the outside of the sample to accelerate fluid pressure equalization. In some cases, common filter paper is used to prevent the migration of fines from the sample, and to provide a source of increased permeability to enhance pressure equalization, while still transferring the applied external confining pressure. The chief limitations are the inherent permeability of filter paper and that the confining pressure reduces the permeability of the filter paper. As such, there is a need for apparatus and methodologies having fluid drainage means capable of achieving higher permeability while still meeting the other requirements. With good drainage it is possible to reduce the length of time in the apparatus to achieve results of acceptable accuracy.

One specific application of these testing methodologies concerns the testing of caprock for thermal recovery of oil and bitumen. Caprock, which is generally non-permeable shale and mudstone, acts as a "cap" or seal to maintain reservoir fluids within the subterranean formation. When the caprock fails, reservoir fluids escape from the reservoir formation, contaminating overlying ground water and releasing fluid to surface. Operators must balance the need to achieve sufficiently high steam pressures within the reservoir to mobilize the hydrocarbons with the risk of over-pressurizing the reservoir and shearing the caprock. The catastrophic results of caprock failure are not only detrimental to the environment, but also have safety implications to any personnel who may be in the area, and are often financially devastating to the operator. Past incidents of this type have significantly impacted the approval of thermal recovery projects by government and energy regulators. In this instance, and other applications, provisions must be made to handle high temperatures and for extended periods.

Another concurrent issue is the design of membranes that separate the sample of geological materials from the fluid which is used to provide the external confining stress. Different fluids are used depending on the required temperatures and there may be chemical interactions between the membrane material and the confining fluid. Different combinations of drains, confining fluids and membranes may be used depending on the test conditions required.

SUMMARY

In one aspect, disclosed herein is a triaxial test system comprising a core sample assembly disposed between a top platen and a bottom platen of a triaxial testing apparatus, the core sample assembly comprising:

a) a core sample having a top end and a bottom end, and a sidewall between the top end and the bottom end;

b) at least one drain disposed on the sidewall of the core sample and extending from the top end to the bottom end of the core sample, wherein the at least one drain is comprised of a material that is able to withstand temperatures of between about +100° C. and about +200° C. in the triaxial testing apparatus;

c) a first porous element on the top end of the core sample, and a second porous element on the bottom end of the core sample;

d) a high temperature-resistant sealing membrane that is able to withstand temperatures of between about +100° C. and about +200° C. in the triaxial testing apparatus, disposed over the core sample, the at least one drain, and the first and second porous elements;

wherein the sealing membrane extends at least partially over the top platen and the bottom platen and is affixed to the top platen and the bottom platen with a high temperature-resistant glue that is able to withstand temperatures of between about +100° C. and about +200° C. in the triaxial testing apparatus.

In embodiments of the system, the sealing membrane is comprised of a shear-resistant material, in embodiments a fluorocarbon elastomer, in embodiments Viton®.

In embodiments of the system, the sealing membrane is a first sealing membrane, and the system further comprises a second high temperature-resistant sealing membrane disposed over the first sealing membrane. The second sealing membrane may be comprised of silicone, in embodiments silicone having a durometer of at least 30A, and in embodiments platinum cured silicone.

In embodiments of the system, the at least one drain may be comprised of a polyaramid fabric, in embodiments, Kevlar®.

In embodiments of the system, the high temperature-resistant glue is silicone glue.

In embodiments of the system, the least one drain is comprised of a polyaramid fabric, the sealing membrane is comprised of shear-resistant material, and the high temperature-resistant glue is silicone glue.

In embodiments of the system, the first sealing membrane is comprised of shear-resistant material, the second sealing membrane is comprised of silicone, and the high temperature-resistant glue is silicone glue.

In embodiments of the system, the at least one drain is comprised of Kevlar® the sealing membrane is comprised of Viton® and the high temperature-resistant glue is Silicone glue.

In another aspect, described herein is a method of triaxial testing comprising the steps of:

a) assembling a triaxial testing system as described above in a housing of the triaxial testing apparatus;
b) filling the housing with a confining fluid;
c) saturating and consolidating the sample for a period of a least one day;
d) increasing the temperature of the confining fluid to between about +100° C. and about +200° C.; and
e) increasing the vertical shear stress on the sample while the sample is maintained at a temperature of at between about +100° C. and about +200° C., until the sample fails.

In embodiments of the method, the temperature is maintained at between about +175° C. and about +200° C., during step e).

In embodiments of the method, the confining fluid is a mineral oil, in embodiments a food grade mineral oil, and in embodiments, UCON™ Lubricant 50-HB-400.

DESCRIPTION OF EMBODIMENTS

Figure 1:
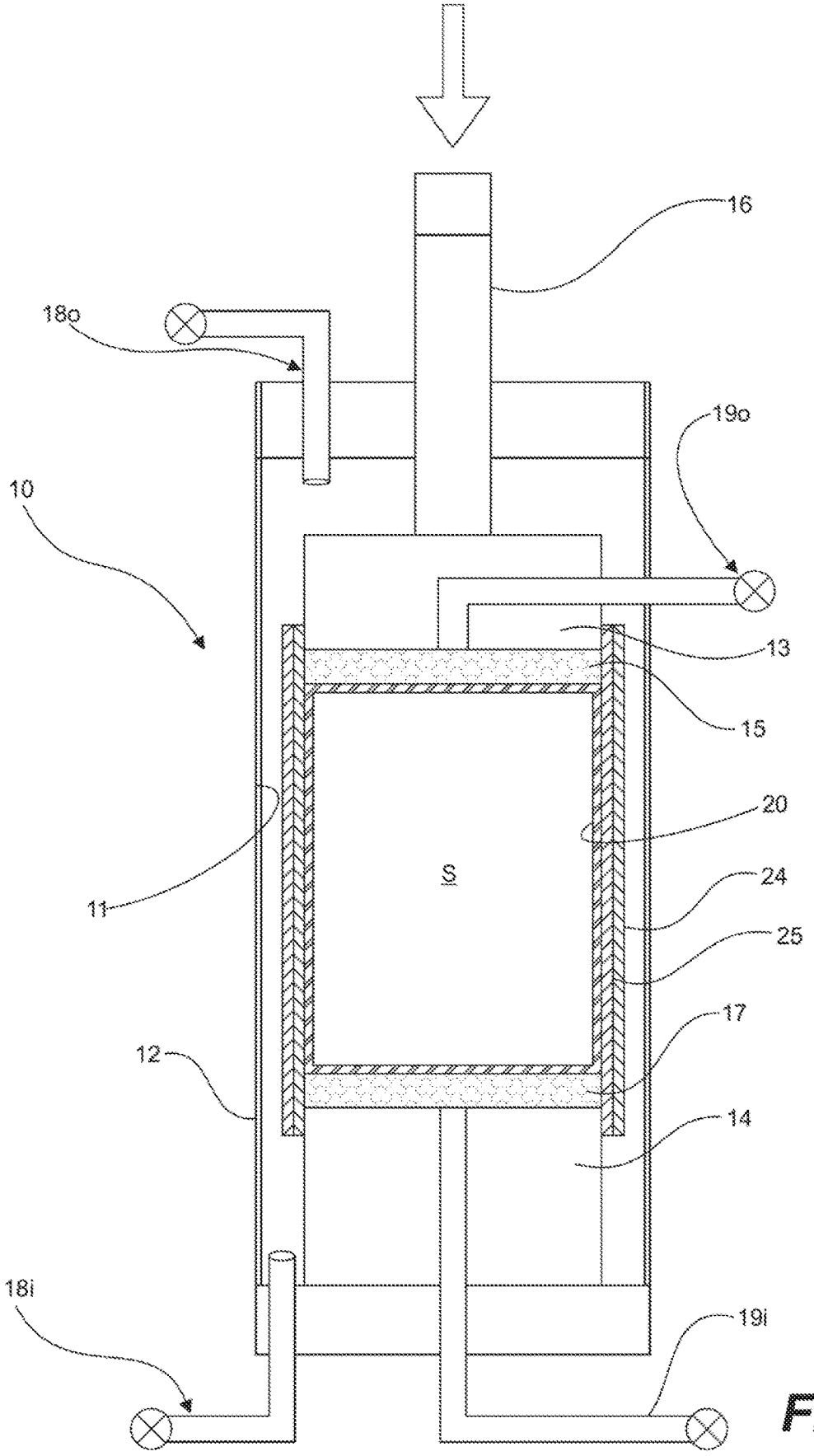
FIG. 1 is a cross-sectional schematic representation of the present triaxial testing system according to embodiments herein.

According to embodiments herein, improved apparatus and methodologies for determining the geomechanical properties of deformable solids are provided. Improved testing apparatus methodologies and techniques are described having regard to FIGS. 1-4. Further, although some of the processes may be known, sample collection and transportation processes are described for explanatory purposes.

By way of example, the testing of caprock samples will be described herein, at conditions similar to those found in subterranean reservoirs during oil recovery processes. As would be understood, caprock is the geological term used to describe the generally impervious rock layer overlying subterranean reservoirs. Where caprock overlies heavy-oil reservoirs, such as those found in Alberta, Canada, the rock serves to contain underground gases and fluids within the reservoir. Due to the nature of caprock, which is generally made up of a stronger low or ultra-low permeable rock type overlying a weaker highly permeable rock type, understanding the integrity of the caprock is as complex as it is important.

Sample Collection and Transport

In order to maximize the accuracy of any geomechanical testing of a core sample, it is imperative that the original sample properties be preserved. For example, the delicate nature of deformable solids like caprock necessitates that proper measures be taken to maintain core samples during drilling and coring, handling, transporting and storing of the sample. Such systems should be in place regardless of the sample type being tested. As described herein, specific sampling processes have been developed to mitigate physical risks (e.g., prevent freezing and moisture loss) and mechanical risks (e.g., prevent stress, fractures, and breaks), optimizing the accuracy of failure criteria being measured. The present systems may be used to determine the integrity of core samples alone or in combination with other subterranean information, such as logging data, geological conditions, etc.

Sampling processes typically comprise the arrival of drilling and coring personnel at the designated sampling site in an environmentally controlled vehicle suitably adapted to provide proper geocontainment during storage and transport of core samples. By way of example, the vehicle may comprise a temperature and moisture controlled truck and trailer, the trailer being specifically adapted to receive and properly secure at least one storage unit (e.g., at least one core box or core tube positioned on the trailer) or be adapted to receive and store samples therewithin (e.g., the trailer itself is adapted to receive core samples). According to embodiments herein, samples may be maintained at approximately +4° C.-+5° C., or any other such desired temperature to prevent freezing and sweating of the samples. According to other embodiments, samples may be secured and stored horizontally within the trailer, such samples being suspended therein to prevent physical damage to the samples during transport. It is desirable that the vehicle be appropriately sized to reach the coring site, while also providing sufficient storage capacity for samples being obtained.

Once in place, the drilling and coring personnel may begin drilling the core sample of interest from the ground. Coring may commence at a desired interval above the desired sample site (e.g., approximately five meters) to ensure that equipment is functioning properly, minimizing the risk of malfunction and loss of precious core samples. It would be understood that any drilling and coring tools may be used to retrieve core samples, provided that various factors such as excessive weight on bit, high bit rotation, high pump pressures, etc. are controlled to minimize physical damage to the core sample during drilling. By way of example, a commercially-available three meter wireline retrievable core barrel with a diamond impregnated core bit, comprising non-slotted aluminum tubes, may be used. As would be known, it is desirable that an entire caprock interval be obtained, the entire interval extending between the upper boundary of the oil sands below the caprock (i.e., where the caprock contacts the oil sands therebelow) up to and including the surface or first formation above the caprock that is considered non-caprock thereabove.

As each core sample is removed from the ground, a small sample (e.g., 60-70 grams) can be removed from the bottom end of each core tube and some on site measurements may be taken, including sample weight, specific gravity, mass etc. After field operations have been completed, the small samples are delivered to the laboratory (described in detail below) and dried, such that the mass can again be recorded, to provide the core sample's original moisture content.

The larger core samples may then be prepared for storage and transportation. For example, the 3 meter long core sample tubes may be may be cut down into smaller sample sizes (e.g., approximately 1.5 meters, or other such size as may be desired) prior to transport to the laboratory. Silicon may be used on the ends of the core tubes to seal on core tube caps to the end of the core tubes, the silicon providing a barrier to moisture, thereby preventing moisture loss from the core during transport and storage before the core tubes are opened for analysis. The larger cores collected on location may then be secured inside the trailer in a manner that maintains moisture content and prevents freezing of the samples during transportation. Core tubes may be configured such that no extra space remains therein (e.g., any remaining space may be filled with protective materials, foam or Styrofoam, to ensure the samples do not shift within the tubes during transport). Core tubes may further be configured to provide sensors operative to detect movement of the tubes, such movement potentially translating to mechanical damage of the samples therein. Such "shock-watch" sensors may comprise mechanical sensors as would be known in the art. In some embodiments, samples may be vacuumed sealed and stored horizontally within the transport vehicle. According to embodiments herein, the core tubes are labeled, securely positioned in the core boxes on the transport vehicle, and transported directly from the sampling site to the processing and testing facilities as quickly as possible.

Core Processing and Preliminary Testing

The present core processing process may commence by processing and testing the core samples within a testing facility. By way of example, the processing of caprock samples will be described herein.

Initial Processing

According to embodiments herein, samples may initially be processed and analyzed upon arrival at the processing and testing facility. Such facility may comprise an environmentally controlled room where temperature and humidity are regulated. As would be understood, samples may be stored at the testing facility indefinitely, although it may be desired to further process the samples as soon as possible after the coring process. Preferably CT scanning of the sample is completed within 24-48 hours after arrival at the testing facility. Upon completion of CT scanning, the core tubes can be opened (e.g., using a "clamshell" method of making a cut down one side of the core tube followed by a second cut down the opposite side of the core tube, creating two halves ("shells"); provided that the blade used does not cut the sample positioned inside the core tube). The sample can be visually examined for natural fractures and it can be photographed, and a geotechnical log can be completed, before being cut into smaller sections (e.g., two 75 cm sections). If required, depth correction can also be completed at this time. The samples can then be sealed back inside the two halves of the core tube, vacuum sealed in plastic, and placed inside an environmentally-controlled room for storage.

Further Processing and Testing

Once a sample is selected for further processing and testing, it is desirable that the sample be tested as soon as possible, and preferably within 3 hours from removal of the core tube. Rapid processing may ensure that original moisture content of the sample is not lost, as even minimal moisture loss (e.g., as low as 2% loss) can render the sample unsuitable for testing.

Sample cores selected for testing may be removed from core tubes for further geotechnical processing and analysis, ensuring that the samples which have maintained the greatest integrity are chosen. Removal of samples may comprise the destruction of the core tube in a manner that prevents reinsertion of the sample therein (e.g., tubes may be cut too short to be reused). Samples may be inspected and additional photographs may be taken prior to testing. Other analyses that may be performed include, without limitation: moisture content, Atterberg limits, grain size distribution, soil texture, XRD, SEM, and thin section petrography.

Triaxial Testing

Upon completion of the initial processing and testing, triaxial testing of core samples may be performed using testing apparatus, systems and methodologies described herein, having regard to FIGS. 1-4. As has become known, triaxial testing is one of the most common methods used to measure the geomechanical properties of many deformable solids and, depending upon the sample being tested, various apparatus and methodologies are known.

As above, there are currently no known testing systems capable of testing deformable solids for long periods of time at high temperatures, i.e., to mimic characteristics of subterranean hydrocarbon reservoirs undergoing thermal recovery processes, like SAGD, CSS or the like. According to embodiments herein, an improved triaxial testing system is provided for testing deformable solids, such as caprock samples, at conditions similar to those found in subterranean reservoirs during oil recovery processes. Improved testing apparatus, systems and methodologies are provided, which are capable of performing triaxial testing of deformable solids for extended periods of time and at elevated temperatures. By way of example only, the present apparatus and methods are described for the triaxial testing of caprock, which has the characteristics of a clay sample, that is, it has very little permeability and does not transmit water at visibly noticeable rates. However, it is understood that other solids may also be tested according to the methods and systems disclosed herein.

Having regard to FIG. 1, a triaxial testing apparatus 10 is provided. As would be appreciated, the testing apparatus 10 comprises a housing 12 (forming a sealed test chamber 11) designed to subject core samples S received therein to axial and radial forces, and to high temperatures for a period of time. In embodiments the temperatures and pressures are substantially equivalent to underground temperatures and pressures in a subterranean reservoir undergoing thermal recovery processes. In some embodiments, the sample S may be a substantially cylindrical sample of deformable earth, such as caprock, having a top and bottom surface and a sidewall, and forming longitudinal axis therethrough. Samples may be appropriately sized for positioning within the housing 12. Although not described or shown, it would be understood that any sensors, componentry or devices (e.g., thermometers, temperature and pressure gauges, etc.) required to operate the apparatus 10 are contemplated herein. In preferred embodiments the basic test cell is obtained from GCTS Testing Systems (GCTS RTX-500 machine).

Samples S typically comprise an approximate 2:1 height-to-diameter ratio, although other desired ratios may be used. A sample may be approximately 6-8 inches (about 150-200 mm) in height (length) and have a diameter of between approximately 3-4 inches (about 75-100 mm) although other lengths and diameters may be used. In embodiments the surfaces of the sample S may be cleaned (e.g., with a knife blade or wire brush) and the end surfaces made flat, in order to obtain an even load distribution. Sample S may be securely positioned within the housing 12 between two parallel upper and lower platens 13,14, such that upper and lower platens 13,14 support the top and bottom surfaces of the sample S, respectively. Platens 13, 14 may be made of metal, for example steel. The upper or lower platen, or both, may be operative to move towards and away from one another to apply axial stress vertically to the sample S along its longitudinal axis. In one embodiment, at least one piston or loading ram 16 may be operatively connected to the upper platen 13, such that piston 16 can impose a downward force (see arrow in FIG. 1) upon the movable platen 13, actuating the platen 13 towards platen 14 and exerting axial stress upon the sample S therebetween. As would be understood, piston 16 may be mechanically- or hydraulically-actuated to impact movement on platens 13,14. While one embodiment is described herein, it is contemplated that other means for applying axial stress to the sample S may also be used.

Housing 12 may be further configured to provide hydraulic fluid means 18 in fluid communication with sealed chamber 11, for supplying pressurized fluid to the chamber 11 and applying radial or "confining" stress to sample S within the chamber 11. Hydraulic fluid means 18 may comprise a circuit for controlled pressurizing (via inlet 18*i*) and draining (via outlet 18*o*) of the sealed test chamber 11 with the pressurized fluid. Housing 12 may be further configured to provide pore fluid means 19, consisting of fluid inlet 19*i* and outlet 19*o*, for providing pore fluids in fluid communication with the sample S and operative to saturate the sample S with fluid as described in more detail below.

Where desired, the top and bottom surfaces of sample S may be positioned between one or more porous elements 15,17 (e.g., porous stones) for enabling fluid flow into and out of the sample S. The porous stones are cut to the same diameter as the diameter of sample S and can be used several times before they break. In embodiments they are 6 mm thick and have a diameter of 4". Moreover, standard filter paper, such as Whatman No. 40 or 54 may or may not be positioned between the sample S and porous stones 15,17.

Saturation Stage/Phase

According to the present systems, sample S may be placed within housing 12 and saturated by the introduction fluids introduced via inlet 19*i* until all voids within the sample S are filled with the fluids (i.e., the sample is "de-aired"). Pore fluid (e.g., water or brine) is allowed to move into and out of the sample as necessary through pore fluid access ports 19, via inlet port 19*i*, passing through platen 14 and outlet port 19*o*, passing through platen 13. There is no fluid communication between the pore fluids and the confining fluids in chamber 11, as described further below.

In some embodiments, the sample S may be allowed to sit for an extended period of time (e.g., 12-24 hours or longer), or until air within the sample S dissolves into the water used to apply pressure on fluids in the pore space, before the consolidation stage (see below) is started. In some embodiments, a low confining pressure (e.g., 0.3 mPa) may be applied to the sample during this stage, which may facilitate removal of air from pores and testing apparatus, as the air becomes more soluble in water or brine as pressure increases. In some embodiments, after it is observed that fluid is flowing along the sides of the sample S, the consolidation stage is started. The surface of a sample that has experienced moisture loss during the sample preparation stage may be rehydrated. Saturation is considered to be complete when the surface of the sample has been rehydrated and any air in the pore pressure system is dissolved into the water or brine. Saturation testing, for example using the ASTM Standard Test Method for Consolidated Drained Triaxial Compression Test for Soil (D7181-11), may be performed to ensure the sample S is sufficiently saturated.

In some embodiments, the pore fluid may comprise formation brines which are present in situ. In some embodiments it may be necessary to use artificial brine to saturate the sample. Brines are corrosive and may require additional expense for corrosion resistant handling vessels. In some cases, fresh water may be used to reduce expense. However, in the case of caprock testing, it would be understood that the caprock being tested may be positioned directly above an underground steam chamber which can reasonably be expected to be contacted by steam condensate (fresh water). Thus, in some embodiments fresh water is preferred over brine.

Consolidation Stage/Phase

After the sample S is saturated, or while the sample S is being saturated, the consolidation stage may commence by controllably applying pressure to platens 13,14 to impose axial strain on the sample S, and by introducing confining fluids to test chamber 11 via hydraulic fluid means 18, increasing the pressure within test chamber 11 to impose volumetric and radial strain on the sample S. Pressures imposed upon the sample S may force fluids contained within the sample S out of the sample S, the volume of said fluids being measured. The loads are applied slowly to allow pore pressures to dissipate and adjust to the surrounding pressures.

Radial strain may be imposed upon the sample S by the introduction of confining fluids into test chamber 11 via inlet 18*i* until fluid pressure within the chamber exceeds the pore pressure of the sample S. In some embodiments, the confining fluids may be provided at confining pressures between approximately 0.1-70 MPa, or between approximately 0.1-20 MPa and typically within the range of about 0.2 to 6 MPa. Radial strain imposed by the confining fluids on the sample S may be monitored by measuring changes in the diameter of the sample S, using known techniques. A typical methodology would be to use a chain coupled to an extensometer. Volumetric strain imposed upon the sample S may be measured by recording the amount of fluid expelled from the sample S throughout the duration of the test. The inherent assumption is that the compressibility of the solid (particles) is much lower than the pore volume change—as evidenced by fluid expulsion.

Typically, both radial and volumetric strain are measured concurrently in a test. While the use of an extensometer will allow the calculation of volume change, the radial strain may be greater than the chain extensometer can measure (i.e., the chain extensometer may break). Further, the measurement of volumetric strain may be inaccurate if the sample only releases a small amount of fluid, as measuring a very small sample size is difficult. Using both methods concurrently provides backup data in the event that one method fails, and allows correlation of data if not.

Axial strain imposed upon the sample S may be determined by a number of methodologies, including for example, measuring and tracking the movement of the platens 13,14 imparted by piston 16. In other embodiments (not shown), rings may be affixed to the sample S with set screws, the rings comprising instrumentation to measure axial movement, or a strain gauge may be affixed to the sample with epoxy glue, the gauge operative to measure axial movement. Axial strain may be calculated by averaging displacements, adjusting for sample dimensions and may be either calculated or observed in real time as testing progresses.

Confining fluids can be selected based upon a number of criteria that include, without limitation, the compressibility of the fluid, temperature stability and also ability to track fluid movements. In some embodiments, confining fluids may be selected from the group consisting of: water, mineral oil, silicone oil, as wells as other lubricants and chemicals. In one embodiment, a non-compressible fluid, such as mineral oil, may be used to pressurize the sealed chamber 11 and therefore to apply the confining pressure to the sample S. Confining fluids (e.g., mineral oil) may be introduced to test chamber 11 via hydraulic fluid means 18. As described in more detail below, confining fluids are not in direct contact with the sample S, or with pore saturation fluids (e.g., water, brine) existing in or introduced to the sample S via pore fluid access ports 19. Sample S is fluidly separated from the confining fluids by at least one flexible membrane 24 or 25. Accordingly, if the confining fluid (e.g., mineral oil) and pore fluid (e.g., water) are not miscible, leaks with the sample S can be identified (e.g., since mineral oil and water are not miscible).

The axial, radial and volumetric loads applied to the sample during the consolidation stage are pre-selected based upon the type of sample being tested. In embodiments, the consolidation stage is considered to be complete when the sample S no longer changes in diameter or height, and when pore fluid no longer drains from the sample S. At this point, pore pressure is considered to have equilibrated with confining pressure.

Shear Stage/Phase

Once sample S is consolidated, vertical shear stress may be applied to sample S, for example by upper and lower platens 13, 14. The testing apparatus 10 may be set at a selected confining stress and set to increase the axial stress with time until failure occurs. In embodiments, sample S is drained during the shearing stage, and the increase in axial strain is set to a slow rate, to allow time for pore pressures that are generated to dissipate, that is, to avoid generation of excess pore pressure. This is particularly important for caprock samples, which typically have a low hydraulic conductivity. While any suitable rate may be used to increase vertical strain with time, in embodiments the vertical strain may increase by a rate of between about 0.01 and about 0.05% per hour, and typically between about 0.02 to about 0.04% per hour, until failure occurs. Load and deformation readings may be continuously recorded by a data acquisition system.

For drained shear conditions, the back pressure valve may be left open and fluids permitted to flow into or out of the sample S. Volume change may be measured by the positive displacement pump used to control the pore pressure, which runs continuously in constant pressure control mode during drained shear.

Typically, shear is measured on four different samples S, which are consolidated to four different confining pressures, for example, 0.5, 1.0, 2 and 4 MPa. This generates a series of Mohr circles at failure, which allows plotting of the failure envelope as the line tangent to the Mohr circles and computation of friction angle and cohesion.

Drains

Figure 2:
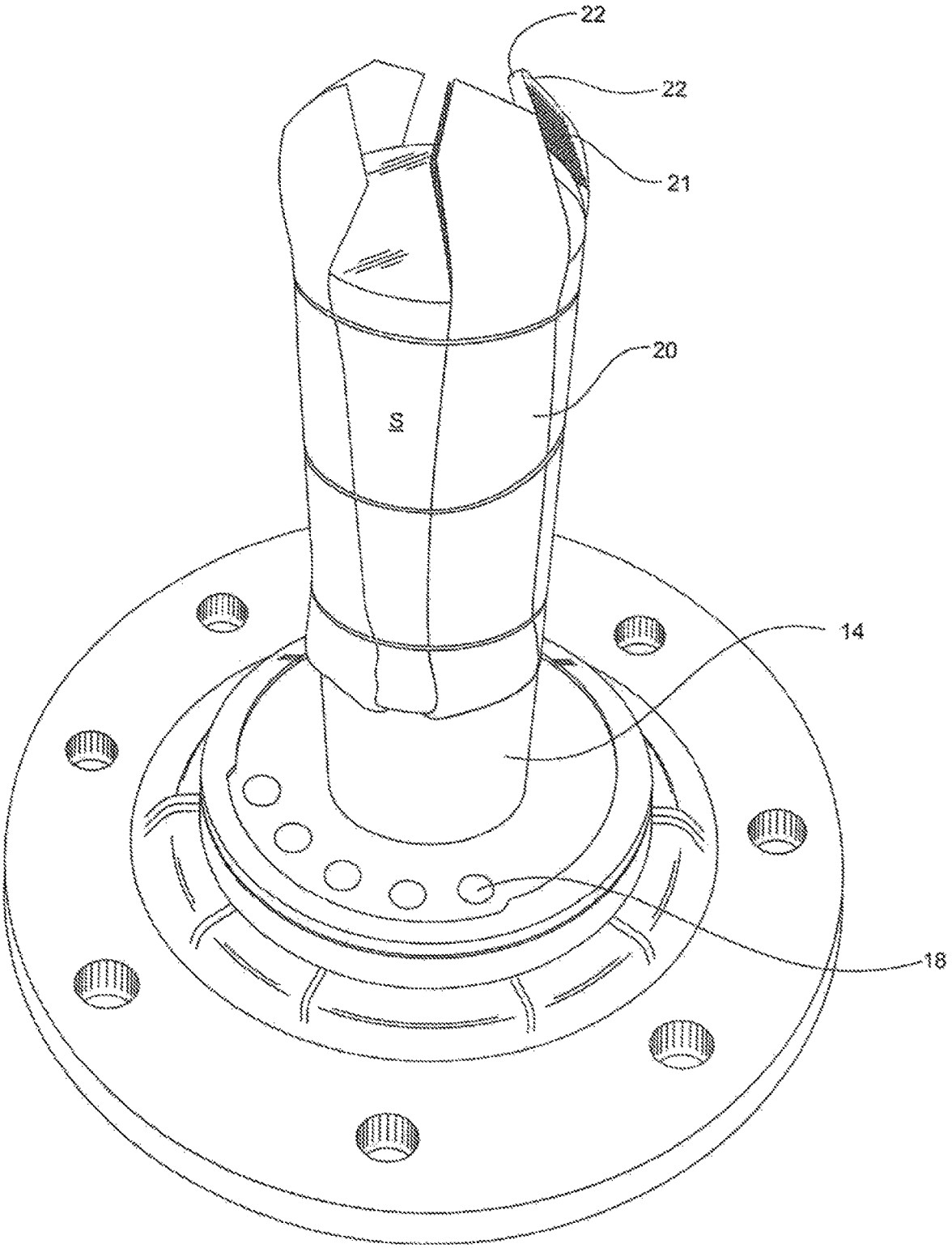
FIG. 2 is a perspective side view of a core sample in position within the test chamber, the chamber and top platen being removed.
Figure 3:
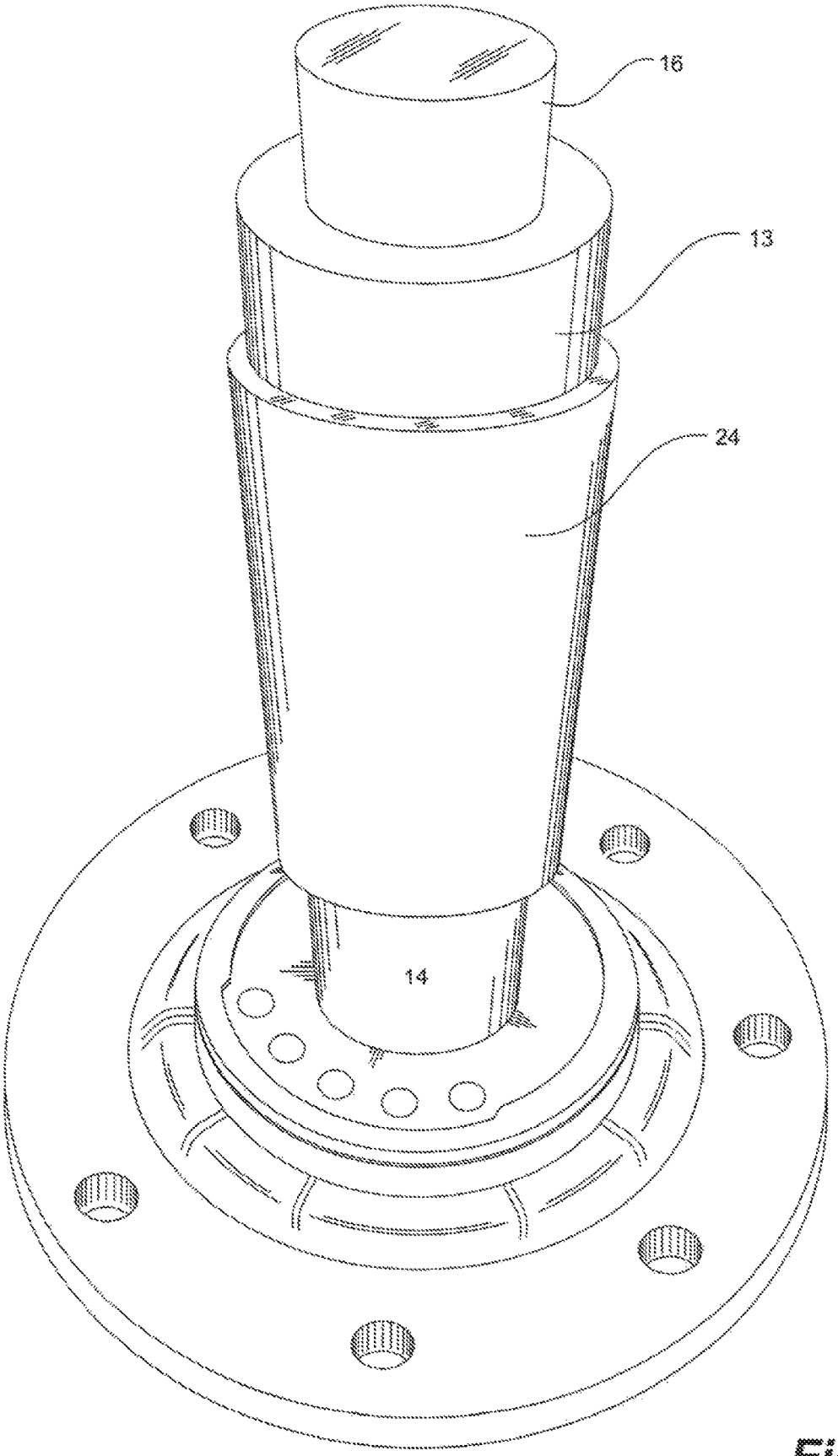
FIG. 3 is a perspective side view of a core sample in position and enveloped by at least one membrane.

Having regard to FIG. 2, at least one drain(s) may be radially spaced around the sidewall of the sample S, extending longitudinally from the top to bottom surface of the sample S and in fluid communication with the filter paper and/or porous elements 15,17 (FIG. 1). Drains 20 may be operative to provide a fluid channel for pore fluids flowing out of the sample S. For example, during the saturation phase, water/air bubbles escaping from the sample S may flow from the sample S upwards along drains 20 to outlet fluid port 19*o*. That is, excess water can be expelled through the top piece of filter paper, through the upper porous stone 15, and out of the apparatus via outlet port 19*o*. As caprock samples typically have very little permeability and do not transmit water at visibly noticeable rates, side drains are used to enhance flow.

It is known to use strips of filter paper, such as Whatman No. 40 or 54 paper, as drains during triaxial testing. However, the inventors have observed that for triaxial tests which are performed over extended periods of time (e.g., more than a day, such as several days) at ambient temperatures, filter paper drains became ineffective. They visibly break apart or disintegrate, or they become compressed, to the point where they are no longer effective to provide a path for pore fluid to drain from the sample S. Therefore, for tests performed over extended periods of time at ambient (or at high temperatures), a more durable drain that remains operable at these conditions is needed. Drains 20, as described herein, are operable for extended periods of time.

It is an advantage of the present drains 20 that they provide additional permeability compared to that provided by traditional filter paper drains. In essence, the present drains 20 provide of a laminated drain, whereby an inner drain layer on the sample face is retained to prevent fines migration, and additional lamination layers provide enhanced permeability via physically connected "channels" within the drains. Optionally, a third outer layer may also be provided. Herein, drains 20 thus provide an easy fluid flow path (or "drainage lines") for fluids escaping the sample S to drain out of apparatus 10.

More specifically, according to embodiments herein, drain(s) 20 may comprise at least one layer of laminated mesh material 21 (e.g., fiberglass window screen) sandwiched between two pieces of filter paper 22, such as Whatman No. 40 or 54. Without being bound by theory, it is believed that fluid channels in the drains 20 are created because the laminated fibers in the mesh do not perfectly compress either one against the other, or against the surface of the sample S (or against the external membranes described in more detail below). As such, it is an advantage that the present drain(s) 20 provide fluid flow channels along which pore fluid may flow more efficiently. Drainage lines may be moistened or saturated (e.g., with water) immediately prior to testing.

Mesh material layer(s) 21 may be manufactured from window screens, plastic strips that have had a groove cut into them with a knife, course cloth or may comprise any materials known in the art. Filter paper layer(s) 22 may be manufactured from standard filter paper, fine cloth or may comprise any materials known in the art. The combinations of materials used in the drains 20 provided herein have greater durability than filter paper drains, a higher drainage capacity and reduce consolidation time as compared to conventional filter paper. An example of a useful mesh material is RCR Easy Screen™ Black Fiberglass Screen.

In some embodiments, mesh material 21 may comprise at least three layers of fiberglass mesh material, wherein the inner and outer layers of material are positioned such that the mesh runs perpendicularly to the longitudinal axis of the sample S. For example, a middle layer of mesh material 21 may be positioned such that the x-y axis of the mesh grid is rotated approximately 45 degrees from the x-y axis of the inner and outer layers of mesh grids (which are positioned to run parallel with one another). In some embodiments, a common latex sealing membrane may then be placed over drains 20, to achieve fluid separation between the sample S and the drains 20, and the confining fluids in the test chamber 11.

In other embodiments, mesh material 21 may comprise at least one layer of cloth roving used for making fiber reinforced plastics (fiberglass or FRP). In such embodiments, the layers or laminations serving as drainage lines are inherent in the material because the cloth itself consists of coarsely woven fiber bundles. As such, fluid flow can occur in the spaces where the fibers do not conform both to each other, and the latex sealing membrane. Advantageously, it was observed that such materials could be used with or without filter paper layers 22 without visible particle invasion. As above, a common latex sealing membrane may then be placed over drains 20, separating confining fluids within the chamber 11 from the drains 20 and porous elements 15,17, and the sample S. Drainage lines within the cloth may be saturated with fresh water immediately prior to testing.

The above drains 20 may be used in apparatus and methodologies to perform conventional triaxial testing of the sample S at ambient temperatures, but are particularly useful when the triaxial testing is performed for an extended period of time (e.g., greater than one day). Standard seating loads may be applied to piston 16, and conventional confining pressures may be applied by fluid means 18, increasing pressure within the test chamber 11. As would be known, to reach the stress conditions specified for a particular test, the confining pressure (i.e., pressure in the test chamber 11) is increased or decreased, as necessary, and the pore pressure adjusted to reach the target confining pressure. For example, the confining pressure in the testing chamber 11 in such tests may exceed the pore pressure by approximately 1 MPa. Small pressure gradients may be used across the sample, typically about 100 kPa. Consolidation stress may be maintained for an extended period of time (e.g., 12-24 hours, or longer) to allow consolidation and saturation of the sample S. Conventional shearing stress may then be applied to the sample S. Such testing may be performed as a preliminary measure to detect any anomalies with the samples, and/or leaks in membrane system 24,25 (discussed in more detail below).

For high temperature triaxial testing (meaning tests performed at temperatures greater than about +100° C. and up to about +200° C.), it has been discerned that the drains 20 described above cannot withstand the temperatures applied, rendering them ineffective for draining the sample S. This can result from the inability of the mesh material 21 to withstand the high temperature (e.g., it melts or disintegrates).

As such, according to embodiments herein, high temperature-resistant drains 20 have been developed that comprise a mesh/woven material 21 capable of withstanding temperatures between about +100° C. and about +200° C. for the duration of the test, meaning that the drains are effective to drain the sample S for the duration of the test. Embodiments of high temperature-resistant drains include, without limitation, drains comprised of polyaramid fabric (e.g., Kevlar®, commercially available from DuPont). In embodiments the mesh material 21 is capable of withstanding temperatures of between about +150° C. and about +200° C., or between about +175° C. and about +200° C., or between about +190° C. and about 195° C. Drains 20 comprised of mesh/woven Kevlar® are particularly useful as they can withstand temperatures of about 195° C., at the pressures used in triaxial testing (e.g., up to about 70 MPa and typically up to about 20 MPa, or between about 0.2 and about 6 MPa), for several days or longer (e.g., at least 12 days). However, it would be appreciated that any material capable of withstanding the high temperatures above, meaning that they are operative to provide drainage channels for fluids escaping the sample S for the duration of the triaxial test, may be used.

In some embodiments, the high temperature-resistant drains 20 may comprise strips of fabric radially spaced around the sidewall of the sample S, the material being situated in a manner similar to the positioning of drains 20 as described above.

High Temperature-Resistant Sealing Membranes

In addition to the improved high temperature-resistant drains 20, the present apparatus and methodologies may provide that the sample S may be further enveloped by at least one and optionally two high temperature-resistant elastomeric sealing membranes 24 or 25. These membranes 24 and 25 may also envelope at least a part of upper and lower platens 13,14, to ensure that the sample S is sealed therein from the confining fluid in chamber 11 (see FIG. 3). In embodiments, sealing membrane 25 is less flexible and more resistant to shear than is sealing membrane 24, as described further below. These membranes 24 and 25 may be manufactured as sleeves that slide over sample S, using molds specifically sized for the sample.

In some embodiments, the high temperature-resistant elastomeric sealing membrane 24 or 25 may comprise a sleeve of a material that can withstand temperatures of between about +100° C. and about +200° C., meaning that it is operative to seal the sample from the confining fluid at temperatures of between about +100° C. and about +200° C., for the duration of the triaxial test. This triaxial test can take a day, several days or longer to complete. In embodiments sealing membrane 24 or 25 is capable of withstanding temperatures of between about +150° C. and about +200° C., or between about +175° C. and about +200° C., or between about +190° C. and about +195° C. for the duration of the triaxial test.

The high temperature-resistant material used to make membrane 24 or 25 must be compatible with the confining fluid used (i.e., operative to maintain the seal between sample S and the confining fluid) for the duration of the test, at the temperatures and pressures applied.

Useful materials for making the high temperature-resistant sealing membrane 24 include, without limitation, silicone (e.g., platinum cure silicone, or the like). A silicone sealing membrane 24 may have a durometer of at least 30A, as calculated by ASTM Standard Test Method D2240, although it would be appreciated that other materials of different hardness may be used. In embodiments the silicone membrane has a tensile strength of less than 3 MPa (420 psi).

Silicone sealing membrane 24 may be manufactured using a mold specifically sized for use with the samples S, ensuring a tight fit between the membrane 24 and the sample S. Exemplary silicone sealing membrane materials are pourable Mold Star™ 30 (30A Platinum Silicon), which is heat resistant up to 450° F. (232° C.) manufactured by Smooth-On, Inc.

Applicant has found that platinum cure silicone sealing membranes are compatible with a confining fluid made of a food grade mineral oil, such as for example a polyalkylene glycol monobutyl ether mineral oil (UCON™ Lubricant 50-HB-400 obtained from the Dow Chemical Company), as this confining fluid is not reactive with the platinum-silicon membrane 24 over the duration of the test.

According to embodiments herein, the present apparatus and methodologies may provide that the sample S may be enveloped by a high temperature-resistant sealing membrane 25 that is also shear-resistant and flexible enough to be positioned over sample S, porous elements 15, 17 and platens 13, 14. This shear-resistant membrane 25 may be used on its own, or in combination with sealing membrane 24 (to prevent a piece of sample from shearing a hole in the sealing membrane 24 when a sample fails).

"Shear-resistant" as used herein means that the material used to make membrane 25 has a minimum tensile strength of about 10 MPa (1450 psi), or of about 11 MPa (1600 psi) or of about 12 MPa (1750 psi) and a minimum elongation before break of about 150%, as determined by ASTM test D412. Exemplary materials that may be used to make elastomeric shear-resistant sealing membrane 25 include, but are not limited to, nitrile rubbers, ethylene-propylene-diene (EPDM) rubbers, and fluorocarbon rubbers.

If too thick, shear-resistant sealing membrane 25 may affect the measurement of the load required for the sample to fail (leading to false data), therefore, the thickness (gauge) of the shear-resistant membrane 25 is preferably less than a thickness that would change the load required for the sample to fail. Also, as sample S consolidates, it's diameter will decrease, and if the shear-resistant membrane 25 is too thin, it will fail (i.e., break of the seal between the consolidating fluid and sample S). Taking these observations into consideration, embodiments of the shear-resistant membrane 25 have a minimum thickness of no less than 40% of the estimated radial shrinkage of the sample S, while offering as little restraint to the sample S as possible. In embodiments, the sleeve of shear-resistant sealing membrane 25 has an inner diameter (unstretched) that is approximately equal to the diameter of the sample.

In embodiments, shear-resistant sealing membrane 25 may comprise a synthetic rubber (e.g., fluorocarbon elastomer), such as Viton®. Viton® is class of elastomers that comprises copolymers of hexafluoropropylene and vinylidene fluoride, terpolymers of tetrafluoroethylene, vinylidene fluoride and hexafluoropropylene as well as perfluoromethylvinylether. In embodiments the shear-resistant membrane is a fluorocarbon elastomer Viton 75 durometer (75A) Membrane, obtained from Hi-Tech Seals Inc. In embodiments the Viton membrane is ¼ inch thick.

Due to the natural heterogeneity of caprock, it would be understood that, according to embodiments herein, the sealing membrane used in the high temperature triaxial tests disclosed herein may be membrane 24, membrane 25, or both membranes 24 and 25. When both membranes 24 and 25 are used, membrane 25 may be positioned outside membrane 24, or membrane 25 may be positioned inside of membrane 24 (see e.g. FIG. 1), such positioning depending upon the expected failure mode of the sample S. By way of example, it is contemplated that a Viton® membrane 25 may be positioned inside a silicone membrane 24, which is the preferred arrangement of these two membranes. This preferred arrangement avoids compression of the more flexible membrane 24 between the sample and the less flexible shear-resistant membrane 25, as compression of membrane 24 may make radial measurements difficult. The squeezing of the inside membrane would not be recorded by the radial LVDT, resulting in lower than actual readings, leading to false or incomplete data.

Because of the heterogeneous lithology of some deformable rock lithology, such as caprock, each sample S can fail slightly differently. It has been observed that samples S will primarily fail plastically first, followed by elastic failure. Plastic failure refers to the shape of the sample S changing, but not to the point that it cannot be reverted back to its original shape (e.g., shortening, swelling, or bulging). Elastic failure refers to the point that irreparable damage is created to the sample and it can no longer be reverted back to its original dimensions (e.g., occurrence of a shear or shear zone and grains within the sample begin to roll over one another). The type of failure can depend upon the clay content and type in the sample S. For instance, some rock formations do not demonstrate plastic failure, and when elastic failure occurs, pieces of the sample S can pierce high temperature sealing membrane 24 or shear-resistant membrane 25, breaking the seal between the confining fluid and sample S. This prematurely ends the test as it precludes the collection of post-failure data. In such cases, both membranes may be used together, with membrane 24 over membrane 25, or vice versa.

In practice, it has been found that it is often sufficient, in high temperature triaxial tests, to use only a shear-resistant sealing membrane 25, such as Viton®. This membrane can withstand temperatures of up to 195° C. for several days or longer at the pressures used in the test (i.e., typically between about +190° C. and about 195° C. MPa). However, it some tests it may be expected or anticipated or observed that, upon shearing, the sample S will pierce membrane 25, and therefore an additional more flexible sealing membrane 24, such as a silicone membrane, may be used over the shear-resistant membrane 25. When failure of the sample S occurs and if the high temperature-resistant and shear-resistant membrane 25 is punctured, the high temperature-resistant membrane 24 may be sufficiently flexible to avoid being punctured as well.

As noted, the shear-resistant membrane 25 may be less flexible than membrane 24, and may be less flexible than the conventionally used latex sealing membrane. When shear-resistant membrane 25 is used alone in a high temperature triaxial test, or when it is used underneath a more flexible membrane 24, the shear-resistant membrane abuts the platens 13,14, and this seals the sample from the confining fluid. It has been found, however, that the seal between shear-resistant membrane 25 and a platen may fail during the consolidation or shearing phase, leading to premature termination of the test because the seal is broken. Without being bound by theory, it is presumed that when volume loss, or the vertical stress applied to sample S causes the platens 13,14 to move vertically, the shear-resistant membrane 25 is not sufficiently flexible to move with the platens, and the seal breaks.

To prevent this, shear-resistant membrane 25 may be glued to platen 13, 14 with high temperature-resistant silicon glue, to maintain the seal between the membrane and the platen during the entirety of the triaxial test. Exemplary silicone glues include GE Clear Silicone II™ sealant, which is applied between the platens and membrane 25 and allowed to set before attaching the measurement devices, lowering the cell and beginning the saturation phase. In embodiments the glue is set for 24 hours. Silicone glues, such as GE Silicone II™ may be used in embodiments where the shear-resistant membrane 25 is Viton®, the platens 13, 14 are comprised of steel, and the confining fluid is a polyalkylene glycol monobutyl ether mineral oil (UCON™ Lubricant 50-HB-400 obtained from the Dow Chemical Company.)

As is apparent, the type of high temperature-resistant glue useful to seal shear-resistant membrane 25 to the platen 13, 14 (or other vertical force-applying means), will vary depending on the types of materials used in the membrane, platen and confining fluid, and the test conditions to be applied. All materials must be compatible with one another for the duration of the test, at the temperatures and pressures applied. Accordingly, the high temperature-resistant glue that may be used to enhance the strength of the seal between shear-resistant membrane 25 and platens 13,14, or between high temperature-resistant sealing membranes 24 and platens 13,14, may be selected based on the materials used in the membranes and platens, the type of confining fluid, and the test parameters.

Figure 4:
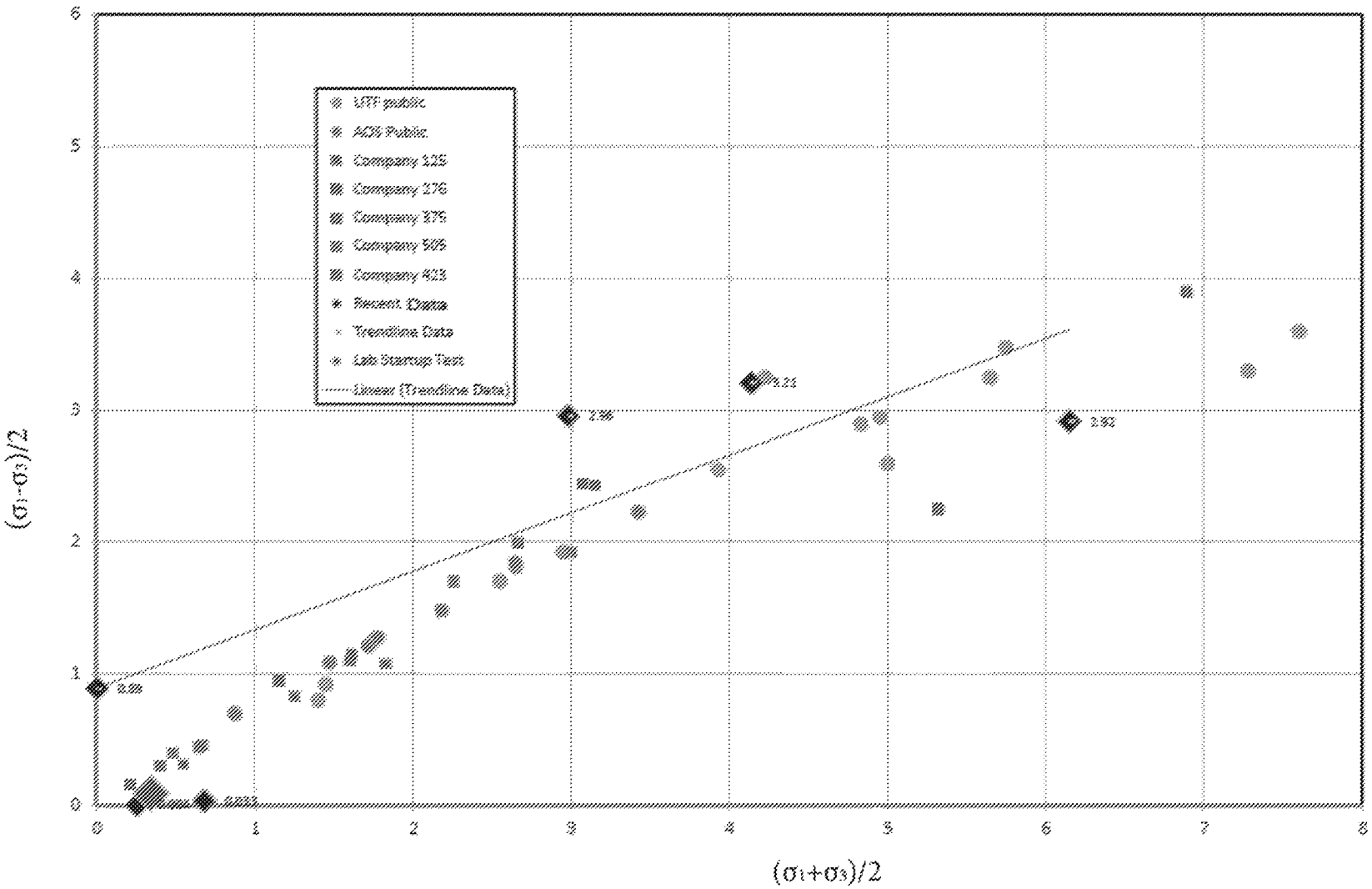
FIG. 4 is graphical representation showing the results of the present improved testing system (diamonds), compared to conventional testing systems (square, circles).

FIG. 4 shows a p'-q' plot comparing the results obtained from the systems and methods disclosed herein to known testing systems. Having regard to FIG. 4, the present systems and methods provide means for testing of deformable solid samples having very low permeability and generally high plasticity (e.g., caprock), enhancing the accuracy of high temperature tests and decreasing the overall time required. For example, when testing was performed at temperatures of up to +200° C. for extended periods of time (e.g., up to, or more than, 24 hours), thereby mimicking real reservoir conditions, the present apparatus and methods is demonstrated to be an accurate testing system (diamonds), performed according to ASTM standards testing, when compared to conventional testing systems (square, circles). If samples are tested too quickly, and complete drainage from the sample S is not obtained, friction angles can be artificially low.

As would be known, for drained shear conditions, a back pressure valve (not shown) can be left open, permitting to flow into or out of the sample S. Volume change can measured by a positive displacement pump used to the control pore pressure, which runs continuously in constant pressure control mode during drained shear. At the conclusion of the triaxial test, the process is stopped, the back and cell pressures are released and the sample S is removed from the testing chamber 11. Each sample is observed and photographed and the mode of sample S failure is analyzed. The sample S is processed for storage and preserved in the temperature and humidity controlled testing facility.

Method

The method for high temperature triaxial testing encompassed by the apparatus, system and methods disclosed herein complies with ASTM Standard test method for consolidated drained triaxial compression tests (D7181-11).

The sample S may be prepared for insertion into the housing of testing apparatus 10 by radially spacing at least one drain 20 around the sidewall of the sample S. The drain 20 may extend between the upper end and lower end of sample S. Porous elements 15, 17 may be disposed on either side of sample S, with the top and bottom ends of the at least one drain 20 situated between sample S and porous elements 15,17.

As above, in lower or ambient temperature triaxial tests, drains 20 may be comprised of one or more layers of laminated mesh material 21 (e.g., fiberglass window screen) sandwiched between two pieces of filter paper 22, or drains 20 may comprise a mesh material 21 comprised of at least one layer of cloth roving used for making fiber reinforced plastics (fiberglass or FRP), without using filer paper. The sample S, drains 20 and porous elements 15, 17 may be enveloped by a common latex sealing membrane, as is known. The sample S thus prepared is then disposed between upper and lower platens 13, 14 in a test chamber 11. The sealing membrane is arranged to extend over at least a portion of platens 13, 14, in a manner that prevents fluid communication between the sample S and the confining fluids (e.g., mineral oil or water). Sensors may be attached, the cylinder housing 12 may be sealingly reassembled and closed to provide sealed chamber 11. Saturation and consolidation typically proceeds for a period of 24 hours, and shearing of the sample S typically proceeds for a period of several days, or even longer (e.g., 3-12 days).

As above, for a high temperature triaxial test (e.g., at temperatures between about +100° C. and +200° C.) drains 20 may be comprised of a material that is capable of withstanding the high temperatures for the duration of the test, such as for example, a woven polyaramid fabric such as, Kevlar®. Sample S, drains 20 and porous elements 15,17 may then be enveloped with high temperature sealing membrane 24 and/or 25 to fluidly separate the drains 20, porous elements 15,17, and sample S from the confining fluids. The first membrane 24 or 25 may be enveloped with an additional membrane 25 or 24, as the case may be, and as described above. High temperature-resistant sealing membrane 24 may comprise silicone, such as a platinum silicone, such as Mold Star™ 30 (30A Platinum Silicon). Shear-resistant membrane 25 may comprise a synthetic rubber, such as a fluorocarbon elastomer, such as Viton®.

Sample S, thus prepared, may then be secured inside testing apparatus 10 between upper and lower platens 13,14. Membrane 24 and/or 25 are positioned to extend over at least a part of platens 13, 14. If only shear-resistant membrane 25 is used, or if shear-resistant membrane 25 is used under membrane 24, then shear-resistant membrane 25 may be glued to platens 13,14 as described above. Sensors may be attached, the cylinder housing 12 may be sealingly reassembled and closed to provide sealed chamber 11.

Testing may begin with a saturation phase, comprising the introduction of saturation fluids (e.g., water or brine) to sample S via inlet 19*i* through porous stone 17 to the sample S. Saturation of the sample S continues until air bubbles within are removed or dissolved. During this phase, water/air bubbles escaping the sample S flow from the sample S upwards along drains 20 to outlet fluid port 19*o*. That is, excess water or brine can be expelled through the top and bottom pieces of filter paper, through the upper and lower porous stones 15, 17, and out through hydraulic means 19 in fluid communication with the upper platen 13.

Once the saturation phase is complete, or while saturation is ongoing, the consolidation phase may begin by increasing the confining pressure in the testing chamber 11 via the introduction of confining fluids (e.g., mineral oil) via hydraulic fluid means inlet 18*i* until fluid pressure within the chamber 11 exceeds the pore pressure of the sample S (e.g., up to about 70 MPa, but typically up to about 20 MPa, and typically between about 0.2-6 MPa). During the saturation and consolidation phase, water or brine contained within the sample S may move out of the sample S and along drains 20, which provide a path for fluids escaping the sample S to drain out of the testing apparatus 10 via 19*o*.

As is known by persons of skill, to reach the target confining pressure specified for a particular test, the confining pressure (i.e., the pressure in the test chamber 11) is increased or decreased, as necessary. The mean effective confining stress and temperature may be maintained for an extended period of time (e.g., 12-24 hours or longer, mimicking steam chamber conditions) to allow the pore pressure to equalize through the sample S and for the sample matrix to consolidate. Consolidation is typically considered to be achieved when fluid no longer drains from the sample S, and the sample size no longer changes. Increasing pore pressure of the sample S causes gas remaining in the sample (e.g., air) to compress, which increases its solubility.

For high temperature tests (that is, tests between +100° C. and +200° C.), temperature is increased after consolidation is finished, usually over a period of 12 to 24 hours. Although temperature may be increased at a faster rate, the risk that water will flash to steam is mitigated by heating the sample over a period of between 12 and 24 hours. Typically, once the maximum temperature is achieved, it is maintained for the duration of the test.

The shearing phase begins after sample S has consolidated. Vertical shear stress may be applied to sample S, for example by upper and lower platens 13,14. The testing apparatus 10 may be set to deliver an increasing axial strain over a period of time, until failure occurs. In embodiments, vertical load is increased by 0.3 to 0.4% per hour. Failure may not occur for several days or even longer (7-12 days). During this time the temperature of the sample may be maintained at between about +100° C. and about +200° C., between about +150° C. and about +200° C., between about +175° C. and about +200° C., and in preferred embodiments between about +190° C. and about +195° C. Load and deformation readings may be continuously recorded by a data acquisition system. For drained shear conditions, the back pressure valve is left open and fluids are permitted to flow into or out of the sample S. Volume change may be measured by the positive displacement pump used to control the pore pressure, which runs continuously in constant pressure control mode during drained shear.

At the conclusion of the shear test, the compression machine is stopped, the back and cell pressures are released and the triaxial cell is removed from the loading frame. The sample S is removed from the testing chamber 11. Each sample is observed and photographed and the mode of sample S failure is analyzed. The sample S is processed for storage and preserved in the temperature and humidity controlled testing facility.

Having regard to FIG. 4, when testing was performed at temperatures of up to 200° C. for extended periods of time (e.g., up to or more than 24 hours), thereby mimicking real reservoir conditions, the present apparatus and methods is demonstrated to accurately determine (diamonds) the strength and stress-strain relationship of a cylindrical specimen, according to ASTM standard D7181, when compared to conventional testing systems (squares, circles).

Example

Provided next is an example of a consolidated and drained triaxial test performed at a high temperature and pressure, and for an extended period of time, on a caprock sample.

A 3.5 inch diameter and 7 inch long sample of caprock was prepared by cutting with a non-ferrous metal blade, and the surfaces cleaned off. The samples dry off visibly on the surface, but the soil is of low permeability and the water in the samples cannot escape quickly. The sample was immersed in water when placed in the triaxial apparatus, thus rehydrating the surface. Since steam will be used for a SAGD process under this caprock, the tests are conducted with fresh water as the pore fluid.

Several strips of Kevlar® were positioned around the sidewalls of the sample and held in place with elastic bands. Each strip extended from the top end to the bottom end of the sample, and over the top and bottom ends. The prepared sample was positioned between two 6 mm thick porous stone elements (endcaps) cut to the same diameter as the sample, with filter paper disposed between the sample and the stone elements.

A sleeve of Viton®, sized to snugly envelope the caprock sample and Kevlar® and endcaps, was extended over the sample, Kevlar® and endcaps using a vacuum activated membrane stretcher. A further sleeve of silicone, such as Mold Star™ 30, 30A Platinum Silicon also sized for a snug fit, was extended over the Viton® sleeve, again using a vacuum activated membrane stretcher. The ends of the Viton® sleeve were extended over upper and lower platens, and glued to the platens with Silicone glue. The glue was set for 24 hours.

On the GCTS RTX-500 machine two rings were attached around the outside of the sample and held in place with set screws. Two high precision Linear Variable Differential Transformers (LVDTs) were attached between the rings to determine axial strain. Axial strain was determined by taking displacement and averaging them. A radial strain device was attached around the outside of the sample.

The samples were then enclosed within a triaxial cell which was then filled with UCON' Lubricant 50-HB-400 mineral oil obtained from the Dow Chemical Company, for the application of confining stresses. The cell was then placed within a high pressure triaxial loading frame. Final assembly of the cell was completed by connecting a back pressure system and cell pressure system. External lines were attached for drainage and instrumentation and both confining pressure and pore pressure are applied. An LVDT was also attached to the loading ram to monitor vertical strain.

Saturation and Consolidation

A seating load of 0.3 MPa was applied. Incrementally, the back (pore) pressure and the cell pressure were increased to approximately 1.0 MPa. The sample was then saturated by flowing water through the bottom drain, through the side drains and out the top of the sample until the air bubbles were removed. Note that the clay samples have very little permeability and do not transmit water at visibly noticeable rates. The flow must therefore occur in the side drains.

The pressure in the cell was increased to over the confining pressure. The mean effective confining stress of 0.3 MPa was maintained overnight to allow consolidation and saturation of the specimen. Note that increasing the pore pressure of the sample caused gas (e.g., air) to compress, which increases its solubility in the pore fluid.

To reach the stress conditions specified for each test, the cell (confining) pressure was increased (or decreased, if necessary) and the pore pressure was adjusted to reach the target confining pressures (1.5 MPa and 3.2 MPa). The sample was then allowed to consolidate for roughly 24 hours to allow the pore pressures to equalize throughout the sample and for the sample matrix to consolidate. The pore fluid volume was monitored to determine when the sample had consolidated. Temperature was then increased to 195° C. over a period of 24 hours.

Shearing

The compression machine was set to an axial strain rate that increased by 0.03 percent/hour. Load and deformation readings were continuously recorded by the data acquisition system. The back pressure valve was left open and fluids were permitted to flow into or out of the sample. Volume change was measured by the positive displacement pump used to control the pore pressure, which runs continuously in constant pressure control mode during drained shear.

Failure of the samples occurred at 7 days. After failure, the test was continued for an additional 1 to 2 days to collect post failure data. The compression machine was stopped, the back and cell pressures were released and the triaxial cell was removed from the loading frame. The cell was then carefully disassembled, pictures were taken of the sample and the mode of failure analyzed.

What is claimed is:

1. A triaxial test system comprising a core sample assembly disposed between a top platen and a bottom platen of a triaxial testing apparatus, the core sample assembly comprising:

a) a core sample having a top end and a bottom end, and a sidewall between the top end and the bottom end;

b) at least one drain disposed on the sidewall of the core sample and extending from the top end to the bottom end of the core sample, wherein the at least one drain is comprised of a high temperature-resistant material that can withstand temperatures of between +100° C. and +200° C. in the triaxial testing apparatus;

c) a first porous element on the top end of the core sample, and a second porous element on the bottom end of the core sample; and d) a high temperature-resistant sealing membrane that can withstand temperatures of between +100° C. and +200° C. in the triaxial testing apparatus, disposed over the core sample, the at least one drain, and the first and second porous elements;

wherein the sealing membrane extends at least partially over the top platen and the bottom platen and is affixed to the top platen and the bottom platen with a high temperature-resistant glue that can withstand temperatures of between +100° C. and +200° C. in the triaxial testing apparatus.

2. The triaxial test system of claim 1, wherein the at least one drain is comprised of a polyaramid fabric.

3. The triaxial test system of claim 1, wherein the at least one drain is comprised of Kevlar®.

4. The triaxial test system of claim 1, wherein the high temperature-resistant glue is silicone glue.

5. The triaxial test system of claim 1, wherein the at least one drain is comprised of a polyaramid fabric, the sealing membrane is comprised of shear-resistant material, and the high temperature-resistant glue is silicone glue.

6. The triaxial test system of claim 1, wherein the at least one drain is comprised of Kevlar® the sealing membrane is comprised of Viton® and the high temperature-resistant glue is silicone glue.

7. The triaxial test system of claim 1, wherein the sealing membrane is comprised of a shear-resistant material.

8. The triaxial test system of claim 7, wherein the sealing membrane is a first sealing membrane, further comprising a second high temperature-resistant sealing membrane disposed over the first sealing membrane.

9. The triaxial test system of claim 8, wherein the second sealing membrane is comprised of silicone.

10. The triaxial test system of claim 7, wherein the shear resistant material is a fluorocarbon elastomer.

11. The triaxial test system of claim 10, wherein the sealing membrane is a first sealing membrane, further comprising a second high temperature-resistant sealing membrane disposed over the first sealing membrane.

12. The triaxial test system of claim 11, wherein the second sealing membrane is comprised of silicone.

13. The triaxial test system of claim 10, wherein the fluorocarbon elastomer is Viton®.

14. The triaxial test system of claim 13, wherein the sealing membrane is a first sealing membrane, further comprising a second high temperature-resistant sealing membrane disposed over the first sealing membrane.

15. The triaxial test system of claim 14, wherein the second sealing membrane is comprised of silicone.

16. The triaxial test system of claim 14, wherein the first sealing membrane is comprised of shear-resistant material, the second sealing membrane is comprised of silicone, and the high temperature-resistant glue is silicone glue.

17. A method of triaxial testing comprising the steps of:

a) assembling the triaxial testing system according to claim 1 in a housing of the triaxial testing apparatus;

b) filling the housing with a confining fluid;

c) saturating and consolidating the sample for a period of a least one day;

d) increasing the temperature of the confining fluid to between +100° C. and +200° C.; and e) increasing the vertical shear stress on the sample while the sample is maintained at a temperature of at between +100° C. and +200° C., until the sample fails.

18. The method of claim 17, wherein the temperature is maintained at between +175° C. and +200° C., during step e).

19. The method of claim 17, wherein the confining fluid is food grade mineral oil.

20. A method of triaxial testing comprising the steps of:

a) assembling the triaxial testing system according to claim 16 in a housing of the triaxial testing apparatus;

b) filling the housing with a confining fluid;

c) saturating and consolidating the sample for a period of a least one day;

d) increasing the temperature of the confining fluid to between +100° C. and +200° C.; and e) increasing the vertical shear stress on the sample while the sample is maintained at a temperature of at between +100° C. and about +200° C., until the sample fails.

21. The method of claim 20, wherein the temperature is maintained at between +175° C. and +200° C., during step e).

22. The method of claim 20, wherein the confining fluid is food grade mineral oil.

* * * * *